US005295327A

United States Patent [19]

Dubois

[11] Patent Number: 5,295,327

[45] Date of Patent: Mar. 22, 1994

[54] SHEET METAL DOOR FRAME AND A METHOD FOR INSTALLING THE SAME IN A DOORWAY

[75] Inventor: Stefan Dubois, Helsingborg, Sweden

[73] Assignee: Swedoor AB, Sweden

[21] Appl. No.: 853,756

[22] PCT Filed: Dec. 14, 1990

[86] PCT No.: PCT/EP90/02198

§ 371 Date: Jun. 4, 1992

§ 102(e) Date: Jun. 4, 1992

[87] PCT Pub. No.: WO91/09168

PCT Pub. Date: Jun. 27, 1991

[30] Foreign Application Priority Data

Dec. 15, 1989 [SE] Sweden ..... 89850435

[51] Int. Cl.[5] ..... E06B 1/04

[52] U.S. Cl. ..... 49/504; 52/211

[58] Field of Search ..... 49/504; 52/211, 212, 52/213, 656.2, 656.4, 656.5, 656.6, 656.9, 204.1, 210; 403/231, 382, 403

[56] References Cited

U.S. PATENT DOCUMENTS

| | | | |
|---|---|---|---|
| 1,574,493 | 2/1926 | Leonard . | |
| 1,747,415 | 2/1930 | Baum | 52/213 X |
| 2,843,232 | 7/1958 | Goldberg . | |
| 2,850,126 | 9/1958 | Furney . | |
| 2,869,695 | 1/1959 | Herr et al. . | |
| 3,141,533 | 7/1964 | Below et al. . | |
| 3,222,833 | 12/1965 | Woodrum | 52/211 |
| 3,363,371 | 1/1968 | Villalobos | 52/210 X |
| 3,385,004 | 5/1968 | Oehler et al. | 52/211 X |
| 3,429,076 | 2/1969 | Fortsch et al. | 49/504 |
| 3,721,055 | 3/1973 | Jerchower | 49/504 X |
| 4,308,692 | 1/1982 | Rumble et al. | 49/504 |
| 4,972,645 | 11/1990 | Gejland et al. . | |

FOREIGN PATENT DOCUMENTS

| | | | |
|---|---|---|---|
| 919508 | 1/1973 | Canada | 52/213 |
| WO8806670 | 9/1988 | PCT Int'l Appl. . | |

*Primary Examiner*—Peter M. Cuomo
*Assistant Examiner*—Jerry Redman
*Attorney, Agent, or Firm*—Lerner, David, Littenberg, Krumholz & Mentlik

[57] ABSTRACT

A sheet metal door frame formed by a substantially horizontally arranged U-shaped head piece and a pair of substantially vertically arranged likewise U-shaped jambs. The jambs preferably have square-cut ends which are arranged to extend into cut-outs at opposite ends of the head piece. The head piece and jambs present side walls, each of which terminates in a free longitudinal end at which an outwardly bent flange is provided for attachment of architraves. The head piece may additionally have hook-shaped end portions formed in its side walls at its opposite ends. These hook-shaped end portions are arranged to overlap end portions of the corresponding side walls of the jambs so as to engage the outwardly bent flanges of the jambs.

9 Claims, 3 Drawing Sheets

SHEET METAL DOOR FRAME AND A METHOD FOR INSTALLING THE SAME IN A DOORWAY

FIELD OF THE INVENTION

The present invention relates to a sheet metal door frame of the type comprising a head piece and a pair of square-cut jambs.

BACKGROUND OF THE INVENTION

Sheet metal door frames offer a simple and highly cost effective alternative to conventional wood frames, and are often installed in doorways of plasterboard walls in offices and similar environments.

The state of the art in the market today is represented by a great number of more or less complicated frame constructions, where head pieces and jambs are joined together by means of a vast variety of tongue elements and slits. The tongue elements can for instance be of the kind used in tinplate toys where the tongue is guided through the slit and bent down on the rear side of the plate. The tongue elements are normally either stamped out from the frame profile, or added by welding or other means as separate parts to the frame profiles. Other known solutions may include intricate angled joint pieces onto which the head piece and jambs are fastened.

A drawback of the majority of the above-mentioned solutions is that the frames become difficult to install on-site by craftsmen. However, it is highly desirable that the frames may be easily installed even by an unskilled craftsman. An additional and no less important drawback of existing frame constructions is the complicated shape of the metal profiles, resulting in high manufacturing costs, for example in terms of expensive cutting and stamping machinery, as well as an increased number of necessary work operations. Yet another problem is that the craftsman of ten has to hold the head piece in position, or fasten it by screws, until the jambs are fixed in their vertical positions.

It is thus an object of the present invention to alleviate the above problems by providing a cheap and simple sheet metal door frame and a method of installing such a door frame in a doorway which can be performed even by unskilled craftsmen.

SUMMARY OF THE INVENTION

In accordance with the present invention these and other objects have been achieved by means of a sheet metal door frame comprising a substantially horizontally arranged U-shaped head piece and a pair of substantially vertically arranged likewise U-shaped jambs, square-cut ends of which jambs extend into cut-outs at opposite ends of said head piece, said head piece and jambs presenting side walls, each of which terminates in a free longitudinal end at which an outwardly bent flange is provided for attachment of architraves, said head piece further presenting hook-shaped end portions formed in its side walls at said opposite ends, which hook-shaped end portions are arranged to overlap end portions of the corresponding side walls of the jambs so as to engage the outwardly bent flanges of the jambs.

In accordance with one embodiment of the door frame of the present invention, the hook-shaped end portions are arranged to engage substantially horizontal edge surfaces of said flanges.

In accordance with another embodiment of the present invention, the edge surfaces are located in a plane defined by the square-cut ends of the jambs.

In accordance with yet another embodiment of the present invention, the hook-shaped end portions are arranged to pass through slit-shaped openings in the flanges adjacent to the square-cut ends of the jambs.

Further in a preferred embodiment, the side walls of at least the head piece are slightly inwardly inclined toward their free longitudinal ends. A clamping effect is hereby created, thereby facilitating the installation of the door frame in a doorway. The angle of inclination of the side walls may favorably be within the interval 0.5° to 6°, preferably 4°.

Furthermore, in the preferred embodiment the side walls of the jambs are each provided with a screw hole at a predetermined location relative to the square-cut ends, said screw hole being aligned with a corresponding screw hole in the overlapping side wall of the head piece.

The invention also provides a method of installing a sheet metal door frame in a doorway having a lintel, said door frame comprising a substantially U-shaped head piece and a pair of likewise U-shaped jambs, square-cut ends of which jambs are intended to extend into cut-outs at opposite ends of said head piece, said head piece and jambs presenting side walls, each of which terminates in a free longitudinal end at which an outwardly bent flange is provided, said method comprising the steps of:

i). installing and securing one of said jambs in the doorway;

ii). clamping the head piece to the doorway lintel in such a manner that hook-shaped end portions of said head piece are angled into engagement with said outwardly bent flanges of the jamb;

iii). angling the remaining jamb into engagement with the hook shaped end portions of the head piece;

iv). adjusting the head piece and remaining jamb relative to the initially installed jamb and securing them by fastening menans, and v). attaching architraves to the outwardly bent flanges.

BRIEF DESCRIPTION OF THE DRAWINGS

The invention will hereinafter be described by way of example only with reference to the accompanying drawings, in which.

DETAILED DESCRIPTION

Figure 1:
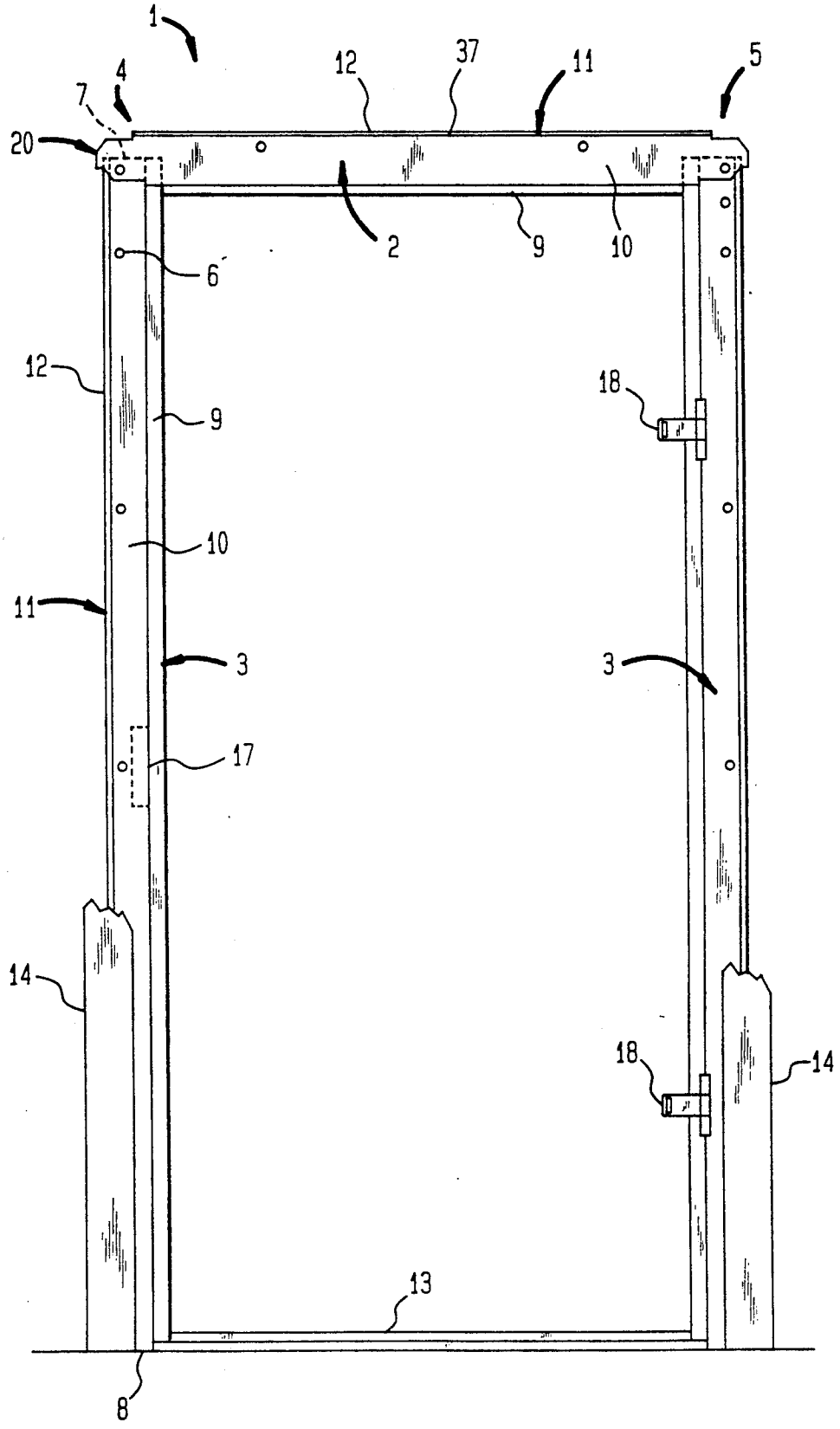
FIG. 1 is a view of a door frame according to the invention, installed in a doorway, the architraves being partially cut away for the sake of clarity.

Referring in detail to the drawings, reference numeral 1 denotes the preferred embodiment of a sheet metal door frame according to the invention. In FIG. 1, the door frame 1 is seen to include a head piece 2 extending horizontally across the top of a doorway and interconnecting at opposite ends 4 and 5 thereof with vertically extending jambs 3, the ends 7 and 8 of which are square-cut. Additionally, a threshold 13 extends in the floor level between the two jambs 3.

Figure 3:
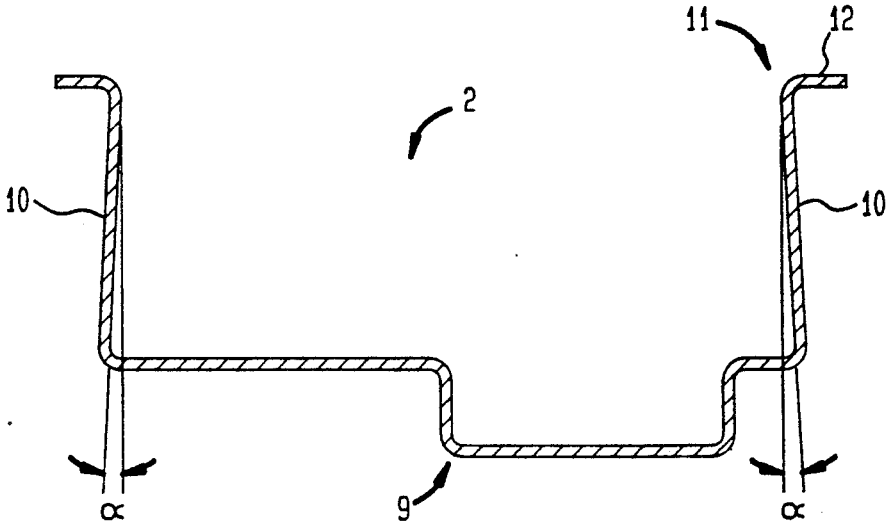
FIG. 3 shows a sectional view of the head piece, illustrating the basic profile shape of the frame.

The head piece 2 and jambs 3 are substantially U-shaped in cross section, having a centrally extending depressed portion, likewise U-shaped in cross section, forming a door stop portion 9 which is clearly shown in FIG. 3. Furthermore, the head piece 2 and jambs 3 each exhibit two opposite side walls 10, provided at their free longitudinal ends 11 with outwardly bent flanges 12 for attachment of architraves 14. The architraves 14 may suitably be of simple rectangular shape having a longitudinal slit 15 corresponding to the outwardly bent flanges 12, whereby said architraves 14 are simply snapped or otherwise attached onto the flanges 12 in a manner known per se. The flanges 12 of the head piece are drawn back a distance from the opposite ends 4, 5, thus allowing joining architraves to meet in either a straight or mitered joint in a well understood manner.

Since the jambs exhibit square-cut ends 7, 8, and since door fittings such as a striking plate 17 and hinges 18 (FIG. 1) are located symmetrically relative to the longitudinal mid-section of the jambs 3, the door frame 1 is fully adaptable to any of the four possible hanging positions of the door leaf (not shown in the figure).

Figure 2:
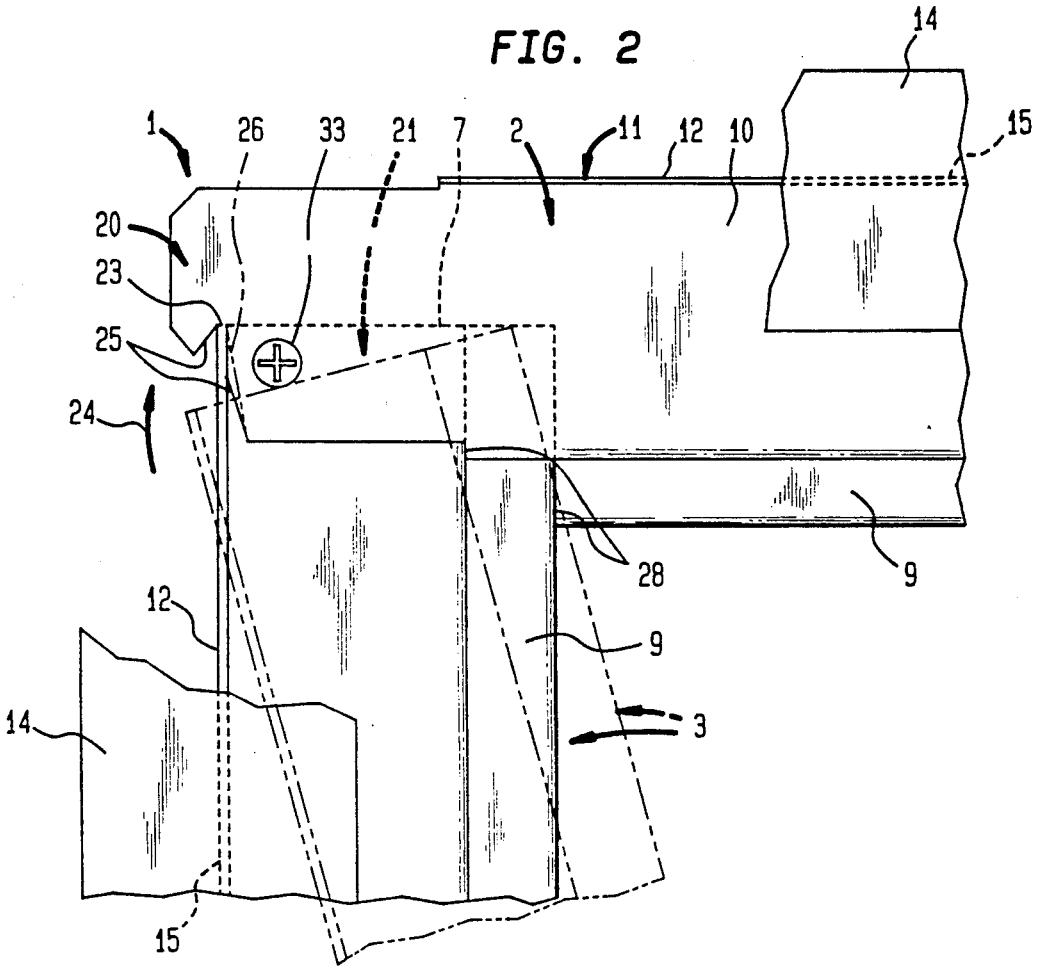
FIG. 2 shows a broken side view of an edge joint of the frame.
Figure 4:
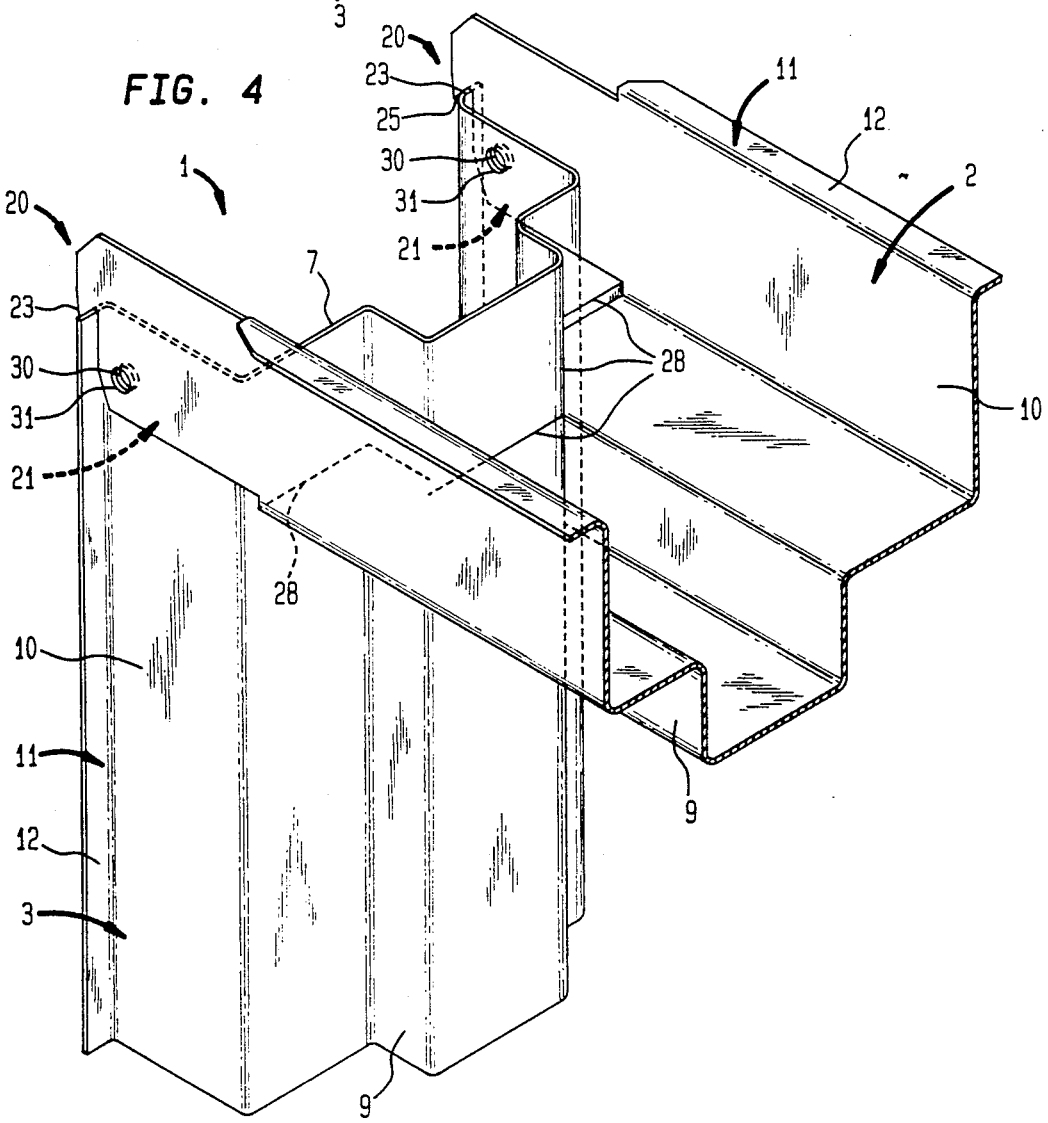
FIG. 4 shows a perspective view of an edge joint according to the invention, where the head piece and jambs are cut short for the sake of clarity.

As can be seen in FIG. 2 and 4, the opposite ends 4, 5 of the head piece 2 are cut out to accommodate the jambs 3. In order that the head piece 2 may interconnect with the jambs 3, it is provided at its opposite ends 4, 5 with hook-shaped end portions 20 formed in the side walls 10. Said hook-shaped end portions 20 are arranged to overlap the end portions 21 of the corresponding side walls 10 of the jambs 3. The purpose of the hook-shaped end portions is hereby to engage the outwardly bent flanges 12 of the jambs 3. More particularly the hook-shaped end portions 20 are arranged to engage substantially horizontal edge surfaces 23 of said flanges 12. In the embodiment shown in FIG. 1, 2 and 4, said edge surfaces 23 are located in a plane defined by the square-cut ends 7 of the jambs 3. In order to allow the jambs 3 to be angled into engagement with the hook-shaped end portions 20, said end portions 20 exhibit a number of angled faces 25, clearly illustrated in FIG. 2. The dot-lined line 26 in FIG. 2 indicates an alternative extension of such a face 25.

When the head piece 2 and the joining jamb 3 are at right angles relative to each other, as shown in FIG. 2 and 4, the edges 28 of the head piece 2 which follow the contour of the jamb are in contact with the perpendicular faces of corresponding parts of the jamb 3. Further in this position, a screw hole 30 in each side wall 12 of the jamb 3 at a predetermined location relative to the square-cut ends 7 is in perfect alignment with a corresponding screw hole 31 in the overlapping side wall 12 of the head piece 2. Hence, the frame 1 can be secured in this perpendicular position with for instance screws 33 through the aligned screw holes 30 and 31 (a screw 33 is shown in FIG. 2, whereas said screws have been left out in FIG. 4 and 5 for the sake of clarity).

Figure 5:
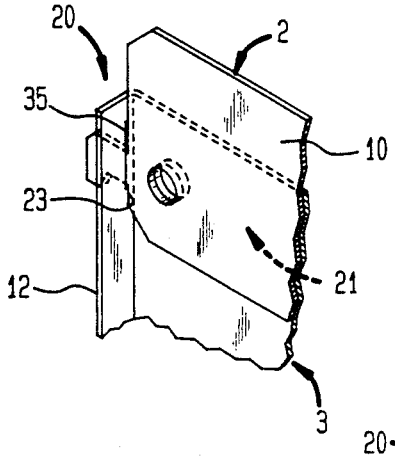
FIG. 5 shows a fragmentary perspective view of an alter native embodiment of the hook-shaped end portions according to the invention.

Another embodiment of the invention is shown in FIG. 5, in which the hook-shaped end portions 20 are formed so as to be insertable in slit-shaped openings 35 cut out in the outwardly bent flanges 12 adjacent to the square-cut ends 7 of the jambs 3. The edge surfaces 23 with which the hook-shaped end portions 20 engage hereby define the bottom sides of said slit-shaped openings 35.

In order to greatly facilitate the installation of the door frame 1 in a doorway, the side walls 10 of the head piece 2 and jambs 3 are slightly inwardly inclined toward their free longitudinal ends 11. In this way a clamping effect is created by means of which the craftsmen may quickly carry out a rough positioning of for instance the head piece 2 by clamping it to the door way lintel 37 (see FIG. 1). The inclination angle $\alpha$ of the side walls 10 may favorably be within the interval 0.5° to 6°. It can easily be understood that the clamping effect is more useful on the head piece 2 than on the jambs 3, since the head piece 2 without the clamping effect would have to be held in position by hand prior to final fastening by screws and the like. Thus, the inclination angle a of the head piece 2 is preferably 4° and said inclination angle a for the jambs 3 may be about 1° or none at all.

A method for installing the door frame 1 in a doorway will be described hereinbelow.

Upon installing the door frame 1, one of the jambs 3, preferably the one fitted with hinges 18, is initially installed and secured in the doorway. When said jamb 3 is secured in its final vertical position, the head piece 2 is clamped to the doorway lintel 37 in such a way that the hook-shaped end portions 20 of said head piece 2 are angled into engagement with said outwardly bent flanges 12 of the jamb 3. At this stage, the head piece 2 is only roughly fitted in its horizontal position. After this, the remaining jamb 3, which in this case is the one fitted with a striking plate 17, is angled into engagement with the hook-shaped end portions 20 of the head piece 2. The initial angled position of said jamb 3 is illustrated in FIG. 2 with dot-lined lines as the jamb 3 is angled into its vertical position in the direction of the arrow 24. When the screw-holes 30 and 31 are in perfect alignment, the head piece 2 and the joining jamb 3 are at right angles to each other. A favorable effect is achieved if the door leaf (not shown in the figures) is hung on the hinges 18 of the initially installed jamb 3. In this way, the door leaf serves as a guide for final adjustment of the head piece 2 and the remaining jamb 3, which are then finally secured in a known manner by fastening means, preferably comprising screws 6, 33. The final adjustment of the frame 1 is thus carried out relative to the initially installed jamb 3. When installing the jamb 3 fitted with the hinges 18, said jamb 3 may favorably be fitted as closely as possible to the doorway, thus providing maximum space between the opposite, remaining jamb 3 and the doorway. This is highly desirable since the striking plate 17 in fact extends to some extent inwards toward the doorway. Finally, the architraves 14 are snapped on or otherwise attached to the outwardly bent flanges 12. An additional help in positioning the frame 1 in the doorway is obtained by the fitting of the threshold 13 between the two jambs 3.

Another possible method for installing the door frame 1 in a doorway is to initially clamp the head piece 2 to the doorway lintel 37, whereafter the jambs 3 are angled into engagement with the hooked-shaped end portions 20 of the head piece 2.

The sheet metal door frame of the present invention can now clearly be seen to achieve the object of the invention and to be well adapted to meet conditions of practical use. The invention is not limited to the embodiments described and illustrated hereinabove. Thus it is to be realized that different embodiments of the invention may be varied within the scope of the accompanying claims. The above-mentioned fastening means may thus for example be nails instead of screws.

I claim:

1. A sheet metal door frame comprising a substantially horizontally arranged U-shaped head piece including first and second ends including cut-out portions, and a pair of substantially vertically arranged U-shaped jambs, said U-shaped jambs including square-cut ends extending into said cut-out portions at said first and second ends of said head piece, said head piece including head piece side walls and said jambs including jamb side walls, each of said jamb side walls terminating in a free longitudinal end including an outwardly bent flange for the attachment of architraves, said head piece further including hook-shaped end portions formed in said head piece side walls at said first and second ends thereof, said head piece side walls being arranged to overlap said jamb side walls whereby said hook-shaped end portions engage said outwardly bent flanges of said jambs.

2. A door frame as claimed in claim 1, wherein said flanges include substantially horizontally disposed edge surfaces, and said hook-shaped end portions are arranged to engage said edge surfaces.

3. A door frame as claimed in claim 2, wherein said edge surfaces are located in a plane defined by said square-cut end portions of said jambs.

4. A door frame as claimed in claim 1, wherein said flanges include slit-shaped openings adjacent to said square-cut end portions of said jambs, and said hook-shaped end portions are arranged to pass through said slit-shaped openings.

5. A door frame as claimed in claim 1, wherein the head piece side walls are inwardly inclined towards the free longitudinal ends thereof to create a clamping effect to facilitate installation of said door frame in a doorway.

6. A door frame as claimed in claim 5, wherein said side walls form an angle of inclination of between about 0.5° and 6°.

7. A door frame as claimed in claim 6, wherein said angle of inclination is about 4°.

8. A door frame as claimed in claim 1 or 5, wherein said jamb side walls and said head piece side walls each include a screw hole at corresponding predetermined locations.

9. A method of installing a sheet metal door frame in a doorway having a lintel, said door frame comprising a substantially U-shaped head piece having first and second ends including cut-out portions and a pair of substantially U-shaped jambs including square-cut ends intended to extend into said cut-out portions at said first and second ends of said head piece, said head piece including head piece side walls and said jambs including jamb side walls, each of said jamb side walls terminating in a free longitudinal end including an outwardly bent flange, said head piece further including hook-shaped end portions formed in said head piece side walls at said first and second sides thereof, said method comprising the steps of:

(a) installing and securing one of said jambs in said doorway;

(b) clamping said head piece to said doorway lintel in such a manner that said hook-shaped end portion at said first end of said head piece is angled into engagement with said outwardly bent flange of said jamb;

(c) angling said remaining jamb into engagement with said hook-shaped end portion at said second end of said head piece;

(d) adjusting and securing said head piece and aid remaining jamb relative to said initially installed jamb by fastening means; and (e) attaching architraves to said outwardly bent flanges.

* * * * *

UNITED STATES PATENT AND TRADEMARK OFFICE

CERTIFICATE OF CORRECTION

PATENT NO. : 5,295,327

DATED : March 22, 1994

INVENTOR(S) : Stefan Dubois

It is certified that error appears in the above-identified patent and that said Letters Patent is hereby corrected as shown below:

Column 6 line 34, delete "aid" and insert therefor --said--.

Signed and Sealed this

Nineteenth Day of July, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,295,327

DATED : March 22, 1994

INVENTOR(S) : Stefan Dubois

It is certified that error appears in the above-identified patent and that said Letters Patent is hereby corrected as shown below:

Title Page:

[30] Foreign Application Priority Data
delete "[SE] Sweden" and insert therefor --[EP] Europe--.

Signed and Sealed this

Twenty-second Day of November, 1994

Attest:

Bruce Lehman

BRUCE LEHMAN

Attesting Officer

Commissioner of Patents and Trademarks